US005225881A

United States Patent [19]

Goto et al.

[11] Patent Number: 5,225,881

[45] Date of Patent: Jul. 6, 1993

[54] IMAGE RECORDING APPARATUS WITH REFEEDING PATH

[75] Inventors: Shinji Goto; Hiroo Kobayashi, both of Tokyo; Masao Ando, Yokohama; Takamasa Sawada, Kawasaki, all of Japan

[73] Assignee: Canon Kabushiki Kaisha, Tokyo, Japan

[21] Appl. No.: 927,720

[22] Filed: Aug. 11, 1992

Related U.S. Application Data

[63] Continuation of Ser. No. 392,413, Aug. 11, 1989, abandoned.

[30] Foreign Application Priority Data

Aug. 12, 1988 [JP] Japan ..... 63-201618
Aug. 15, 1988 [JP] Japan ..... 63-202028

[51] Int. Cl.[5] ..... G03G 15/00; B65H 1/30

[52] U.S. Cl. ..... 355/319; 355/311; 271/3.1

[58] Field of Search ..... 355/309, 311, 318, 319, 355/24, 26, 3; 271/3.1, 248-252

[56] References Cited

U.S. PATENT DOCUMENTS 4,685,793 8/1987 Sawada et al. ..... 355/311
4,724,460 2/1988 Shinyashiki ..... 355/308
4,758,862 7/1988 Fukae et al. ..... 355/319
4,763,166 8/1988 Watanabe ..... 355/315

FOREIGN PATENT DOCUMENTS 0295612A 12/1988 European Pat. Off. .
59-211062A 11/1984 Japan .
61-007159A 1/1986 Japan .
61-072276A 4/1986 Japan .
62-186277 8/1987 Japan ..... 355/319
2141109 12/1984 United Kingdom ..... 355/311

*Primary Examiner*—Joan H. Pendegrass
*Attorney, Agent, or Firm*—Fitzpatrick, Cella, Harper & Scinto

[57] ABSTRACT

An image recording apparatus includes a sheet material accommodating device for accommodating sheet materials, a sheet material feeding device for feeding the sheet materials from the sheet material accommodating device, an image recording device for recording images on the sheet materials fed by the feeding device, sheet material refeeding device for refeeding to the image recording device through a refeeding passage the sheet material on which an image has been formed by the image recording device, a sheet material reversing device for reversing the sheet material and conveying it to the image recording device, the sheet material reversing device being disposed downstream of the refeeding passage with respect to a movement direction of the sheet material substantially within a projection area of the sheet material accommodating device.

30 Claims, 17 Drawing Sheets

IMAGE RECORDING APPARATUS WITH REFEEDING PATH

This application is a continuation of application Ser. No. 07/392,413 filed Aug. 11, 1989, now abandoned.

FIELD OF THE INVENTION AND RELATED ART

The present invention relates to an image recording apparatus such as a laser beam printer, more particularly to an image recording apparatus capable of forming images on both sides of a sheet.

There is a recent demand for an image recording apparatus capable of forming images on both sides of a sheet (duplex print). As an exemplary image recording apparatus of this type, a laser beam printer is shown in FIG. 1.

In this printer, a sheet S0 accommodated in a cassette 100 or 101 is fed out by a pick-up roller 102 or 103, and is fed to a neighborhood of a photosensitive drum 105 at the timing determined by a registration roller 104. While the sheet is being fed in this manner, a latent image is formed on the photosensitive drum 105 with a laser beam from a laser unit 106, and the latent image is developed by a developer such as toner. The toner image is transferred from the drum 105 onto the sheet S0, and the sheet S0 is conveyed to an image fixing device 107 where the image is fixed thereon.

When images are recorded on both sides of the sheet S0, a flapper 108 disposed adjacent to the fixing device 107 is switched to guide the sheet S0 to a switch-back unit 109 disposed in the front side of the apparatus, so that the sheet S0 reaches a reversible roller 110. The reversible roller 110 rotates in a direction for discharging the sheet S0 to the outside of the apparatus. When a sensor 112 detects the passage of the trailing edge of the sheet S0 through the sheet guide 111, the roller 111 is reversed to direct the sheet S0 to the sheet passages 113*a*, 113*b* and 113*c* formed at the bottom side of the apparatus for 10 refeeding the sheet to the photosensitive drum 105 to form an image on the other side. The most downstream sheet passage 113*c* extends to the registration roller 104. The conveying passage 113*c* is provided with a sensor 114 for detecting a sheet, and when the leading edge of the sheet is detected by the sensor 114, the sheet S0 is temporarily stopped, so that the timing of the refeeding is controlled for the second side recording. In this manner, the sheet S0 is reversed in the switch-back unit 109, and is conveyed along the sheet passages 113*a*, 113*b* and 113*c*, by which the printed side of the sheet faces down when the second image is recorded on the sheet S0.

When a number N of sheets are subjected to duplex printing operation, a second page image is printed on a first side of a first sheet S1, which is then conveyed into the sheet passages 113*a*, 113*b* and 113*c*, and which is stopped when its leading edge passes by the sensor 114. Then, the second sheet S2 is fed, and it receives an image for its second side, that is, a fourth page image on its first side, and the second sheet S2 is conveyed into the sheet passages 113*a*, 113*b* and 113*c*. At a predetermined interval from the second sheet S2, the first sheet S1 is refed, and it receives an image for its first page on its second side. Thereafter, the sheet S1 is discharged onto the tray 116 through a discharge passage 115, with the first page facing down. At a predetermined interval from the refeeding of the first sheet S1 for the second page recording, a third sheet S3 is fed, and an image for its second side, that is, the sixth page image is formed on its first side.

In the similar manner, an image for a second page side (first side) for an n-th sheet, that is, a 2n-th page image; an image for a first page side (second side) of a (n−1)th sheet, that is, a (2n−3)th page image; an image for a second page side of a (n+1)th sheet, that is, (2n+2)th page image;—; an image for a second page side of an N-th sheet, that is, a 2N-th page image; an image for a first page side of (N−1)th sheet, that is, (2N−3)th page image; and an image for a first page side of the N-th sheet, that is, (2N−1)th page image; are formed on the respective sheets. Finally, the N-th sheet $S_N$ is discharged on the tray 116 with its second page side, that is, the 2N-th page facing up.

Since, however, the conventional arrangement includes the switch-back unit just downstream of the fixing device 107 at an end of the apparatus, the following problems arise:

(1) The switch-back mechanism is projected from the main assembly portion of the apparatus, and the space extending from the reversible roller 110 through a length substantially equal to the length of the sheet is required for the switching back operation. This results in that the apparatus has a total length which is a sum of a length of a cassette, a length of the sheet conveying passage and the length of the switch-back station. This sum is approximately three times the length of the sheet, which results in a bulky apparatus.

(2) When the second side of the sheet is to be recorded, the sheet stops when it passes by the sensor 114. The stoppage time is not constant but changes in accordance with a signal coming to the main apparatus. In addition, the switch-back station is disposed between the fixing device 107 and a reversing sheet conveying passage 113*a*, and therefore, the sheet can not be stopped half way. For those reasons, it is not possible for the next sheet to be fed, recorded or introduced into the sheet passage 113*a*. Therefore, when two or more sheets are to be subjected to the duplex printing operations, the interval between the first sheet and the second sheet is relatively large, so that longer time loss is necessitated, particularly when a small number of sheets are duplex-printed, repeatedly.

In order to solve those problems, consideration has been given to having the sheet stopping position disposed after the switch-back station. However, it will result in a complicated structure for the sheet passages, and it requires a complicated sheet conveying control in accordance with the sizes of the sheet, with the result of increased cost.

In the duplex recording in the conventional arrangement, the length of the recording sheet passage through which the sheet is conveyed during the second side recording (a first page image) is much longer than when the first side is to be recorded for the second page image, and therefore, the recording sheet is laterally (perpendicular to the direction of the sheet conveyance), deviated and therefore, the position of the second side image is deviated.

To obviate this problem, it is considered that an abutment guide or the like for controlling the lateral position of the recording sheet 52 is disposed at a proper position, for example, a position indicated by a reference C in a passage for the second side recording. By the guide, the recording sheet S0 is refed to the recording station 105 after it is adjusted in its lateral position (the adjustment will hereinafter be called "lateral registration").

When, however, this method is used, the abutment guide has to be adjusted each time the size of the recording sheet changes, which is cumbersome. In addition, because of the complicated structure, the recording sheet is more easily jammed, and the apparatus becomes bulky with increase of cost.

SUMMARY OF THE INVENTION

Accordingly, it is a principal object of the present invention to provide an image recording apparatus capable of forming a duplex print or a superposed print which is small in size and wherein the sheets are conveyed efficiently.

It is another object of the present invention to provide an image forming apparatus wherein the lateral registration is assured without difficulty for various sizes of the sheets with a simple structure, and wherein the recording sheet is not easily jammed.

According to an aspect of the present invention, there is provided an image forming apparatus wherein an image is formed on a sheet fed from sheet feeding means by image recording means; the recorded sheet is reversed by sheet reversing means and is refed to the image recording means; the sheet reversing means is disposed downstream of the sheet refeeding passage with respect to movement direction of the sheet in the manner that the sheet is reversed by the sheet reversing means in a projection area of the sheet feeding means.

In operation for the duplex print for the sheet in the apparatus, a sheet having received an image on its first side is reversed in its facing orientation by the sheet reversing means and is refed to the image recording means through a refeeding passage. At this time, the sheet is reversed in a projection area of the sheet feeding means, and therefore, the space for the sheet reversing is not extended out of the apparatus horizontally.

Since the sheet reversing means is disposed downstream of the sheet refeeding means with respect to the sheet conveyance direction, the second sheet is recorded at a predetermined interval and can be introduced into the refeeding passage at the time of plural sheet duplex printing operation even if the first sheet is waiting for the refeeding. This is because the vacant passage is sufficient for accommodation of the second sheet.

In the present invention, the sheet reversing action for the second image formation on the same sheet is performed in the projection area of the sheet feeding means, and therefore, the switch-back station is not projected out of the main assembly, whereby the size of the entire apparatus can be reduced.

In addition, since the sheet reversing means is disposed downstream of the sheet refeeding means, the time loss otherwise required for the first and second sheet recording during the continuous duplex print operation, can be reduced. In addition, the control of the sheet reversing means can be easily and independently performed.

Furthermore, according to the aspect of the present invention, the length of the refeeding passage can be reduced, and the first print can be quickly produced.

According to another aspect of the present invention, there is provided an image forming apparatus wherein a recording sheet is fed from a sheet feeding station to a recording station where an image is formed; the recording sheet is reversed in a reversing station and is refed to the recording station for formation of a second image, the reversing station and the feeding station are formed as a unit, and a lateral registration means for lateral registration of the recording sheet is provided in the reversing station.

In operation, during the reversing operation after the recording sheet receives the first image on its first side, the lateral registration is adjusted.

With the structure, the lateral registration can be performed without the conventional cumbersome operation even if the size of the recording sheet changes. In addition, since the adjusting means and the sheet feeding station constitute a unit, the size of the recording apparatus is not increased. In addition, even if the sheet is jammed, the recording sheet can be easily removed by taking the feeding station out.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
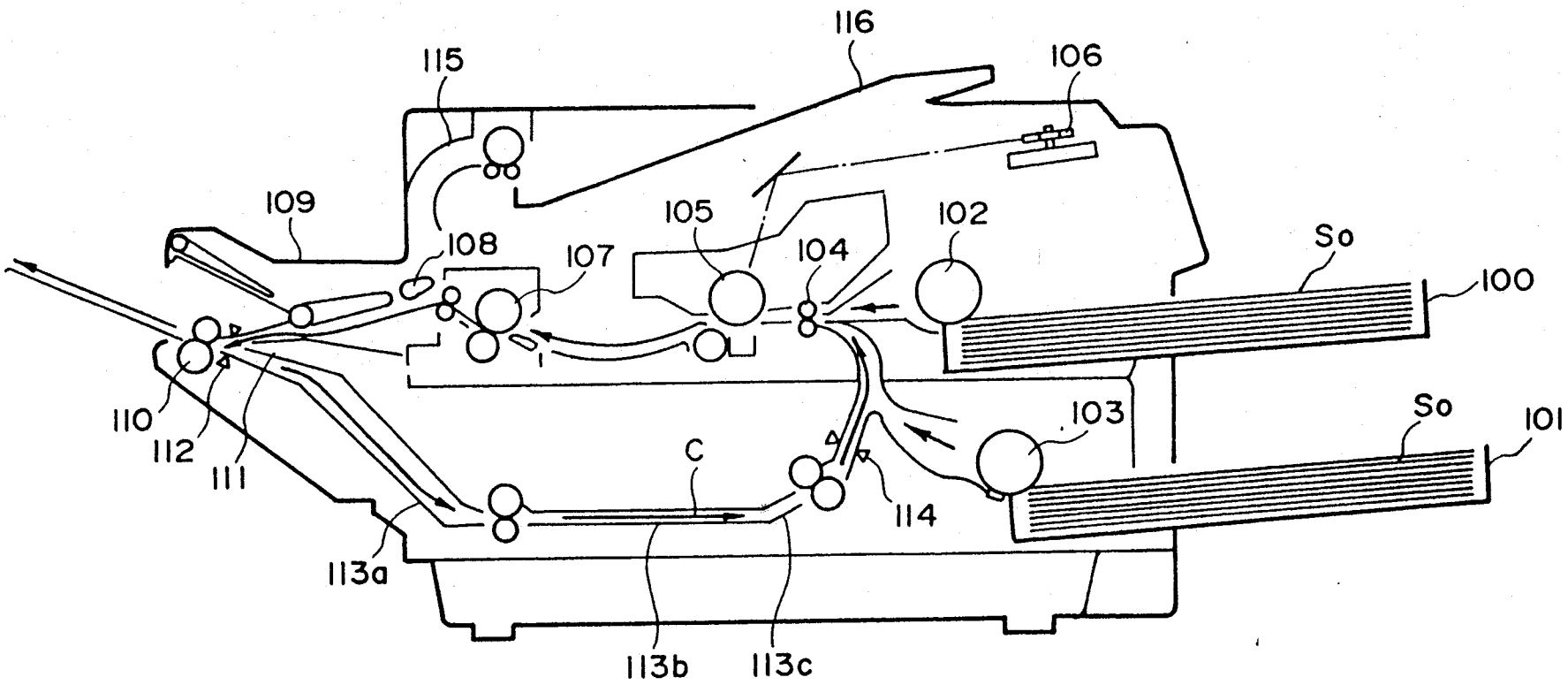
FIG. 1 PRIOR ART
FIG. 1 shows a longitudinal section of a conventional image recording apparatus.
Figure 2:
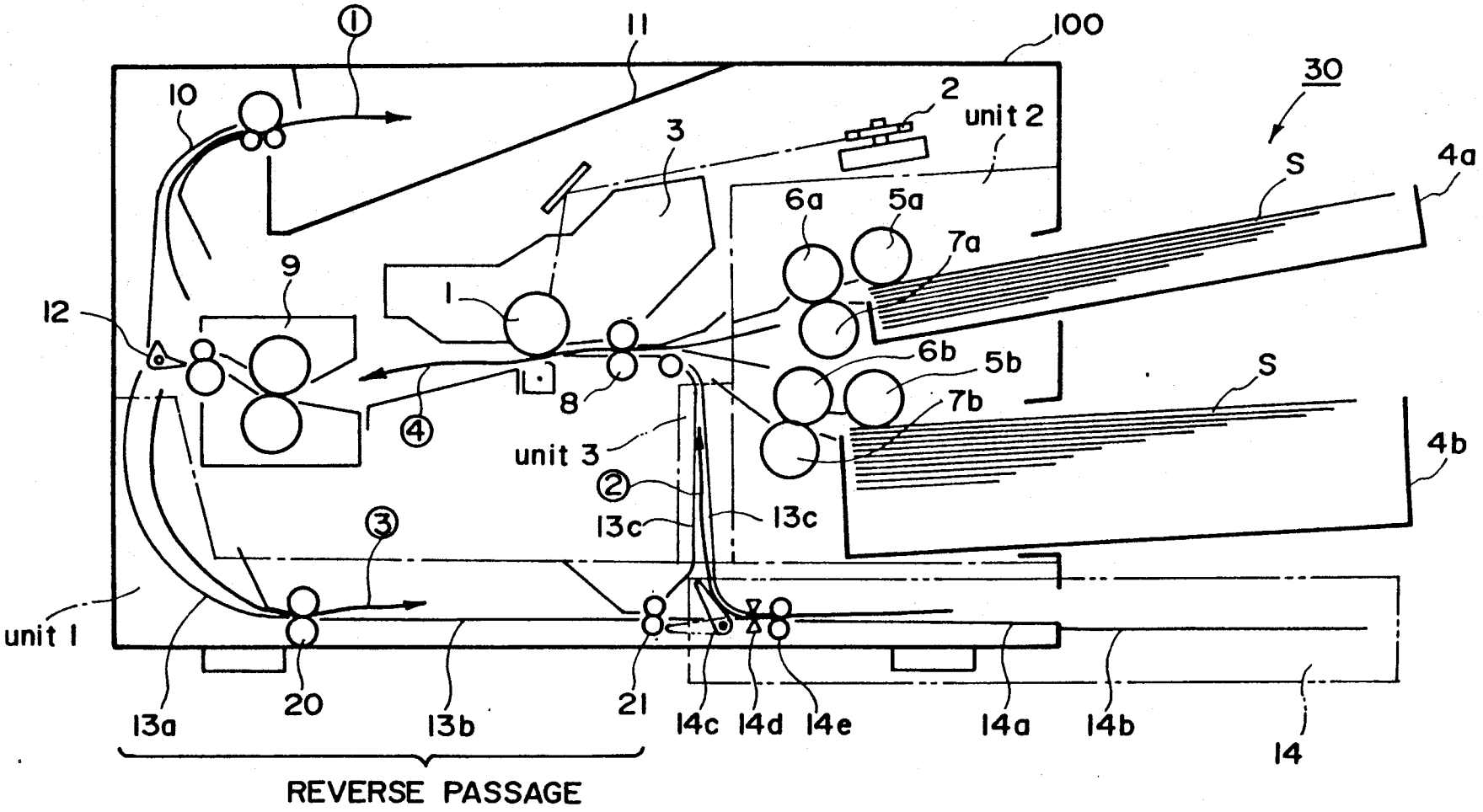
FIG. 2 is a longitudinal sectional view of an image recording apparatus according to a first embodiment of the present invention.

Referring to FIG. 2, there is shown an exemplary image recording apparatus of an electrophotographic type according to an embodiment of the present invention, wherein the image recording apparatus is shown as comprising a photosensitive drum 1 (an image bearing member), on which a latent image is formed by a laser beam from a laser unit 2. The latent image is developed with toner in a process unit 3 (image recording station), the process unit 3 having as an integral part the photosensitive drum 1.

At the righthand side of the apparatus 100, that is, at the front side thereof, there is sheet feeding means 30 for feeding a sheet, wherein two cassettes 4*a* and 4*b* for accommodating sheets S are disposed in two stages. The topmost sheet S in the cassette 4*a* or 4*b* is picked up by a pick-up roller 5*a* or 5*b* and is separated from the remainder with certainty by a sheet feeding roller 6*a* or 6*b* and a double-feed preventing roller 7*a* or 7*b*, to a registration roller 8. At the left side, that is, the rear side of the apparatus 100, there is an image fixing device 9 for fixing the toner image transferred onto the sheet S. Above the fixing device 9, there are sheet discharge passage 10 and a discharge station 11 for a simplex print. Designated by a reference numeral 12 is a flapper for switching the sheet conveyance.

Below the process unit 3 and the fixing device 9, there are reversing passages 13*a*, 13*b* and 13*c* functioning as a sheet refeeding passage for the purpose of the recording on the second side of the sheet. The sheet S having the fixed image on its first side is refed to the neighborhood of the registration roller 8 by a pair of conveying rollers 20 and 21.

In this embodiment, in order to reduce the size of the apparatus, a sheet switch-back station 14 functioning as the sheet reversing means is disposed below the cassette 4*b*.

The switch-back station 14 comprises trays 14*a* and 14*b* for supporting the sheet to be switched back (reversed), a flapper 14*c* for selectively directing the sheet S conveyed from the sheet reversing passage 13*b* either to the trays 14*a* and 14*b* or to the sheet reversing passage 13*c*, a sensor 14*d* for detecting a trailing edge of the sheet S introduced into the switch-back station 14 and the trailing edge of the sheet S to be refed to the process unit 3 from the switch-back station 14, and a pair of reversible rollers 14*e* for switching-back the sheet S.

The switch-back station 14 is so constructed as being retractable from the main assembly 100 together with the pick-up rollers 5*a* and 5*b*, feeding rollers 6*a* and 6*b* and the double-feed preventing rollers 7*a* and 7*b*. Therefore, the switch-back station can be adjusted after it is taken out of the apparatus. The sheet feeding unit is provided with an unshown base plate and a CPU (central processing unit), so that not only the mechanical adjustment of the unit but also electric and soft inspection can all be adjustable within the unit. The switch-back station is constituted as a unit 1; the sheet feeding station is constituted as a unit 2; and the sheet guiding portion is constituted as a unit 3. The units 1 and 3 may be optional.

Figure 3:
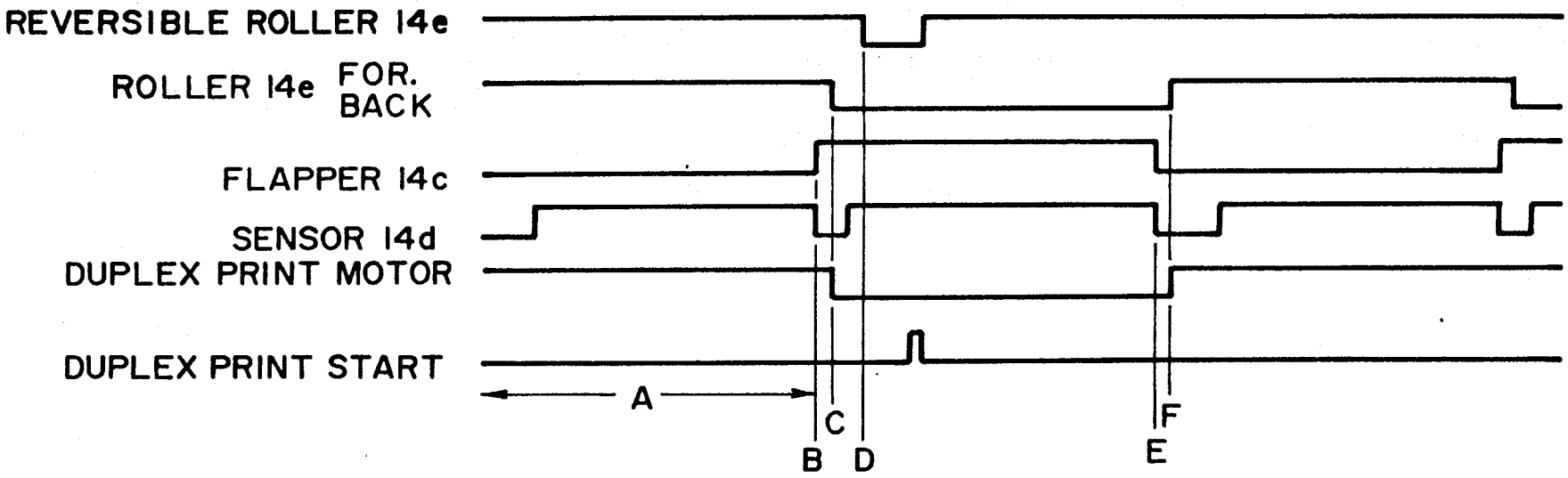
FIG. 3 is a timing chart illustrating a switch-back operation in the apparatus of FIG. 2.

Referring to FIG. 3, the operation of the switch-back station 14 will be described. An image is recorded on a first side of a sheet S, and then the sheet S is conveyed to the switch-back station 14 through the reversing passages 13*a* and 13*b*. At this time, the flapper 14*c* is laid down as shown by chain lines in FIG. 2. With this state, the conveying rollers 20 and 21 are driven by a duplex print conveying motor to advance the sheet S to the trays 14*a* and 14*b* of the switch-back station (time A in FIG. 3). When the trailing edge of the sheet S passes by the sensor 14*d*, the flapper 14*c* is erected as shown by solid lines in FIG. 2 (time B, FIG. 3). Further, the reversible roller 14*e* is reversed (time C, FIG. 3), by which the sheet S is refed for the second side image print. At this time, the duplex print conveying motor is stopped to prevent the next sheet S from being fed.

The reversible roller 14*e* is stopped (time D in FIG. 3) after a predetermined time period elapses from passage of the leading edge of the refed sheet (the trailing edge before being switched back) by the sensor 14*d*. Then, it waits for the main apparatus 100 to produce the image signal for the second side print to enable the recording operation, so that the image signal and the sheet refeeding are timed. When the trailing edge of the sheet S is detected by the sensor 14*d*, the flapper 14*c* is restored to the position indicated by the chain lines in FIG. 2 (time E in FIG. 3), and thereafter, the conveying rollers 20 and 21 are driven, and simultaneously, the reversible roller 14*e* is rotated in its forward direction (time F in FIG. 3) so as to enable the switch-back operation of the next sheet S.

As described in the foregoing, in the present embodiment, the switch-back station 14 is disposed below the cassette 4*b* substantially within a projection area of the cassette 4*b*. Therefore, the switch-back station is not projected out of the main assembly of the apparatus, as contrasted to the conventional apparatus, and therefore, the size of the apparatus can be reduced. In addition, since the switch-back station 14 is accommodated in the sheet feeding unit and since the CPU for controlling the sheet feeding unit is accommodated in the sheet feeding unit, the mechanism for feeding the sheet S to the process unit 3 (the image recording station) can be all adjusted and inspected independently.

In this embodiment, the stoppage of the sheet S for waiting for the refeed instruction signal is independently performed by the switch-back station 14 disposed downstream of the reversing passage, and therefore, even if the first sheet S1 is waiting for refeeding, it is possible to stop the driving motor for the second side image formation conveyance for conveying the next sheet S2, a predetermined period after the stoppage of the first sheet S1. In other words, the simultaneous stoppage is not required. As a result, it is possible that the first sheet S1 is fed, and thereafter the second sheet S2 is fed at a predetermined interval between the sheets.

Figure 4:
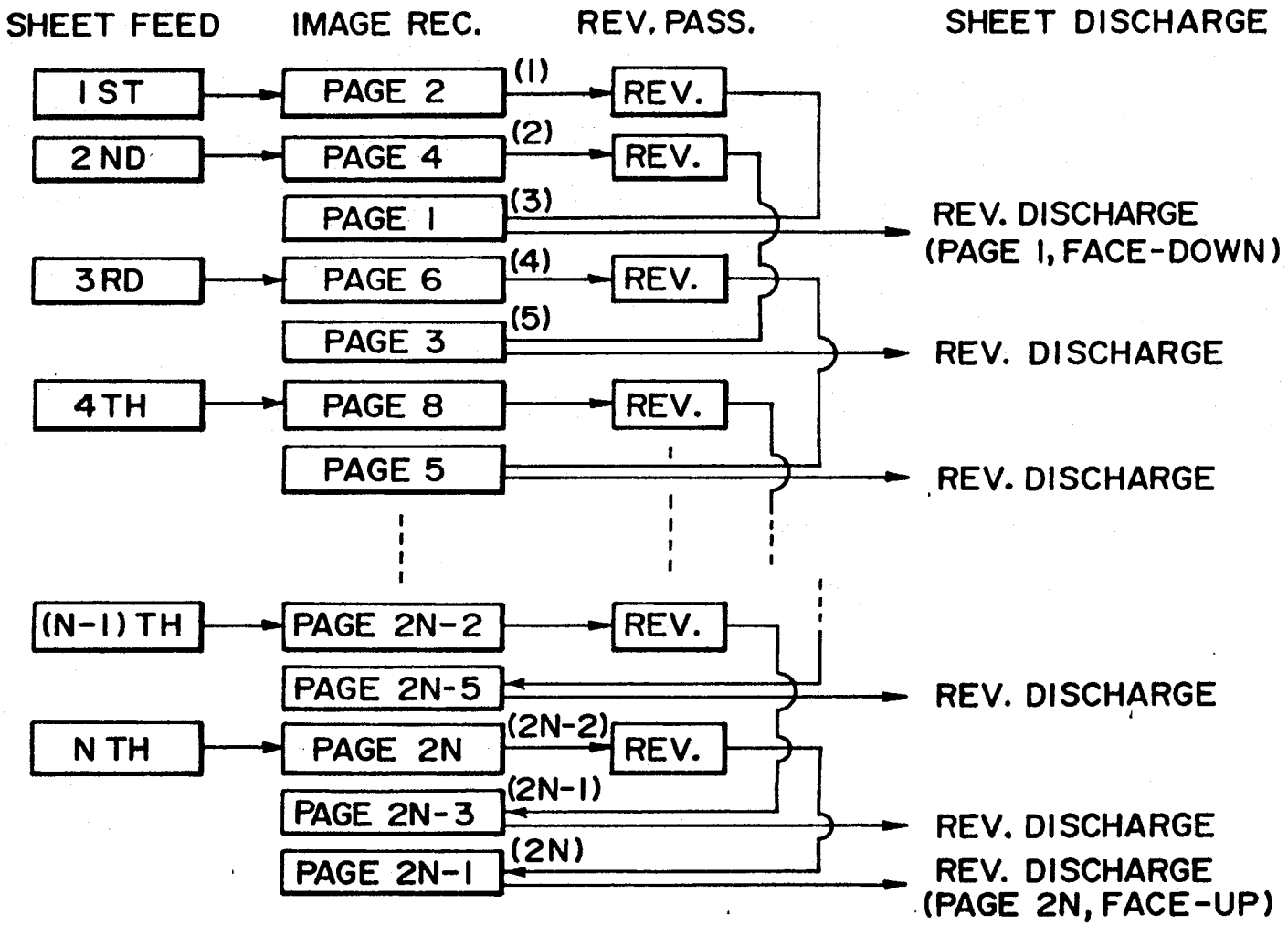
FIG. 4 shows a process when duplex printing operation is effected to N sheets.

Accordingly, as shown in FIG. 4, the image recording control may be to form the images in the following order as shown in FIG. 4: a second page side of the first sheet (a second page, step (1)), a second page side of the second sheet (a fourth page, step (2)), a first page side of the first sheet (a first page, step (3)), a second page side of the third sheet (a sixth page, step (4)), a first page side of the second sheet (a third page, step (5)), a second page side of a fourth sheet (an eighth page, step (6)),—, a second page side of an n-th sheet, a first page side of the (n-1)th sheet, a second page side of an (n+1)th sheet,—, a second page side of an N-th sheet (a 2N page, step (2N-2)), a first page side of the (N1)th sheet ((2N-3)th page, step (2N-1)), and a first page side of an N-th sheet (a (2N-1)th page, step (2N)), continuously. Therefore, the time loss required by the conventional apparatus for the first and second sheets can be eliminated.

The sensor 14*d* for the switch-back control also functions as a sensor for the sheet refeeding, whereby the controls which are important for the duplex print can be concentrated on this area. Therefore, the attention may be paid on this area regarding the mechanical accuracy or the like, and the attention may be paid only the sheet jam regarding the other portions. This makes the arrangement of the part and the electric control easier.

As contrasted to the conventional example, the switch-back station 14 of this embodiment does not involve a wasteful part, and therefore, the reversing passage required for the second side recording can be made shorter, whereby the speed of the first print can be increased.

In addition, according to this embodiment, the switch-back station 14 can be used as a third sheet feeding inlet by inserting the sheet S directly from the outside of the apparatus, so that the utility of the apparatus can be increased (FIG. 2).

Figure 5:
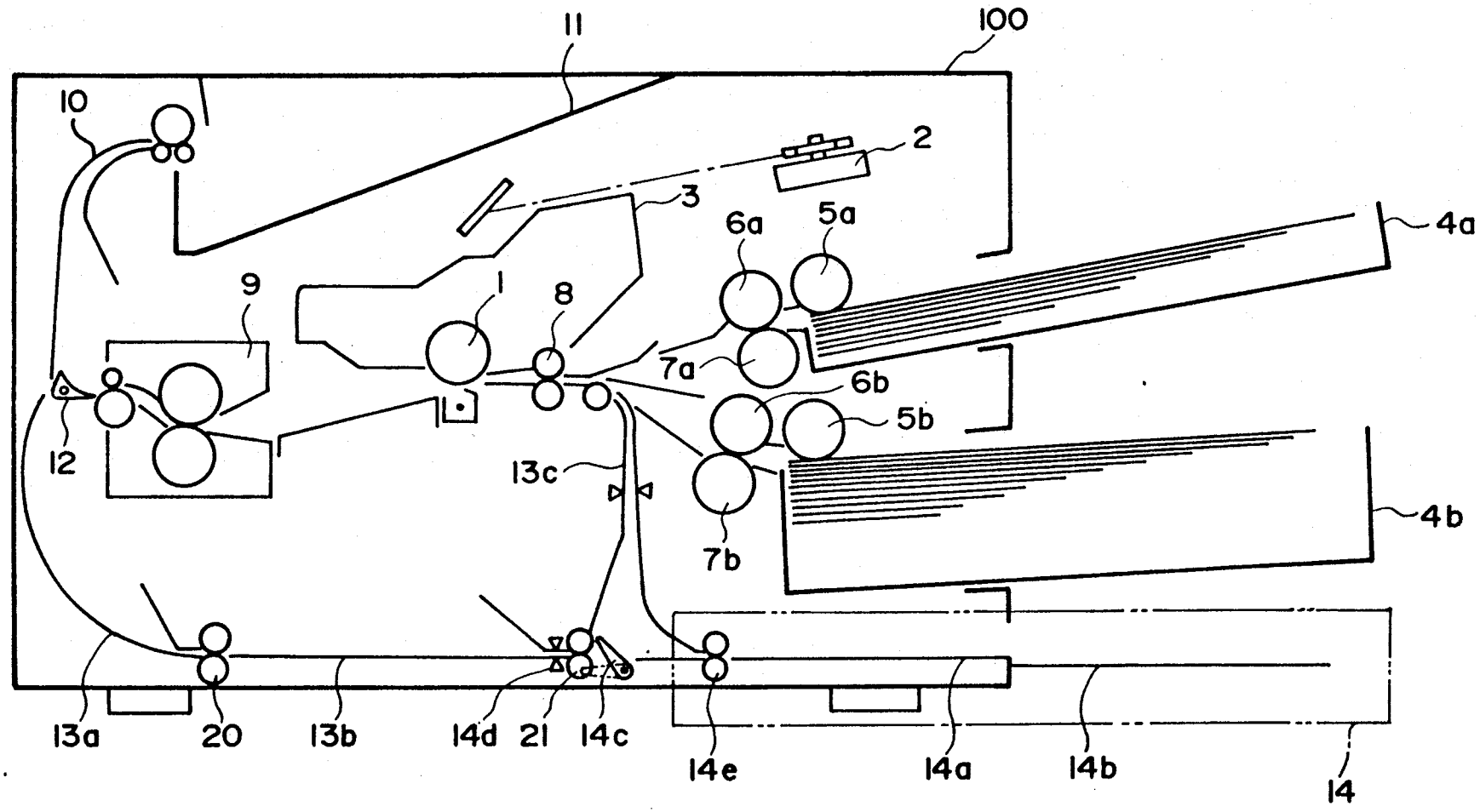
FIG. 5 shows a longitudinal section of an image forming apparatus according to a second embodiment of the present invention.

Referring to FIG. 5, a second embodiment of the present invention will be described wherein the structure of the switch-back station is different from that of the foregoing embodiment. The same reference numerals are assigned to the elements having the corresponding functions.

In this embodiment, a relatively larger space is provided at a merging point between the most downstream reversing passage 13*c* and the switch-back station 14. The sensor 14*d* for detecting the trailing edge of the sheet S is disposed adjacent the upstream side of the conveying roller 21. The flapper 14*c* takes normally the chain line position, and the rollers 14*e* are normally spaced apart. When the sheet S for receiving the second side image is introduced into the switch-back station 14, and its trailing edge is detected by the sensor 14*d*; the flapper 14*c* is erected to direct the trailing edge of the sheet to the most downstream reversing passage 13*c*. At this time, the rollers 14*e* are contacted to grip the sheet S to enable the conveyance of the sheet by them. In this embodiment, the switch-back operation can be effected without reversing the roller 14*e*, and therefore, the mechanism and the control can be made simpler.

Figure 6:
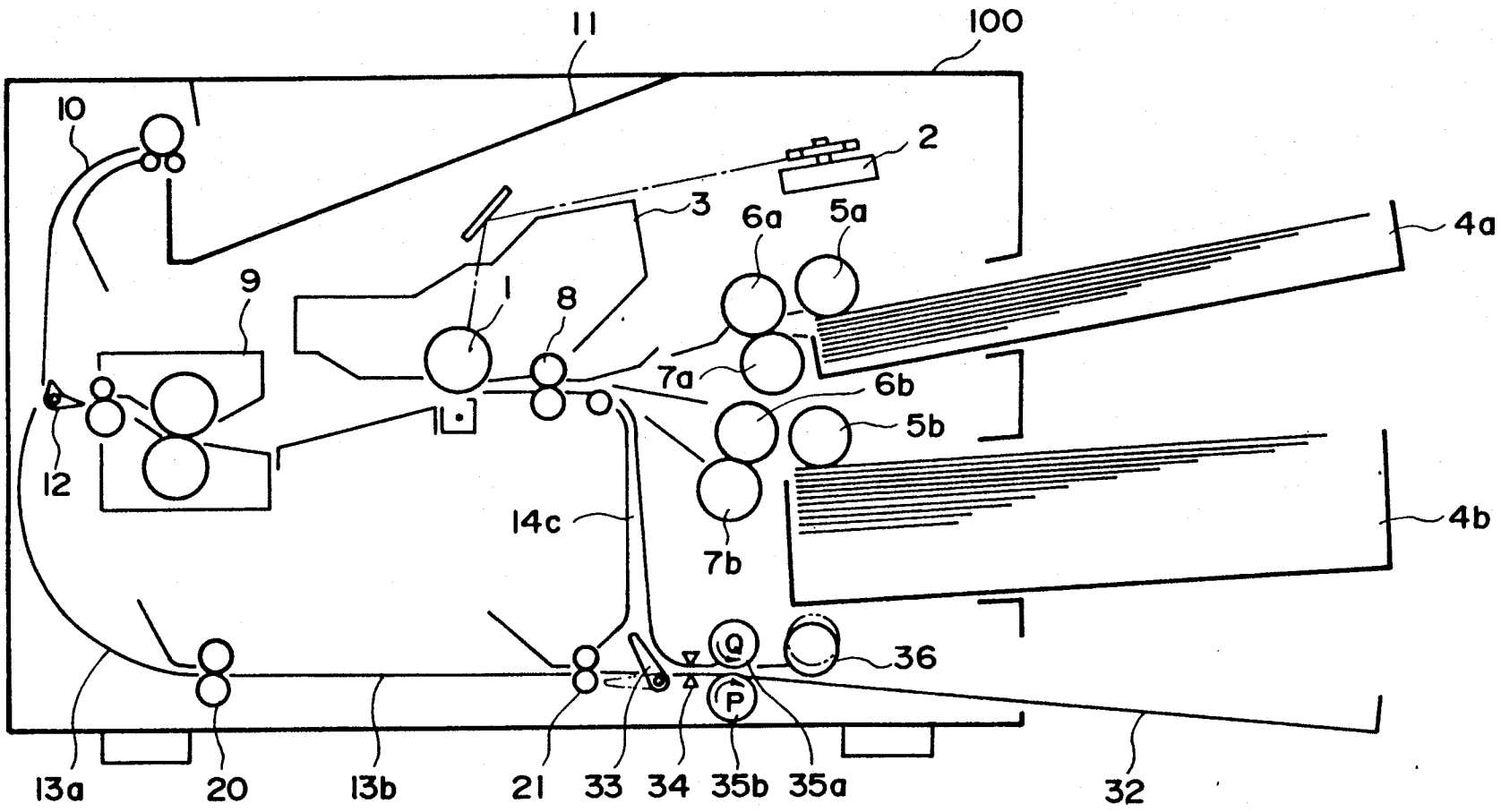
FIGS. 6 and 7 show longitudinal cross-sections of an apparatus according to a third embodiment of the present invention.
Figure 7:
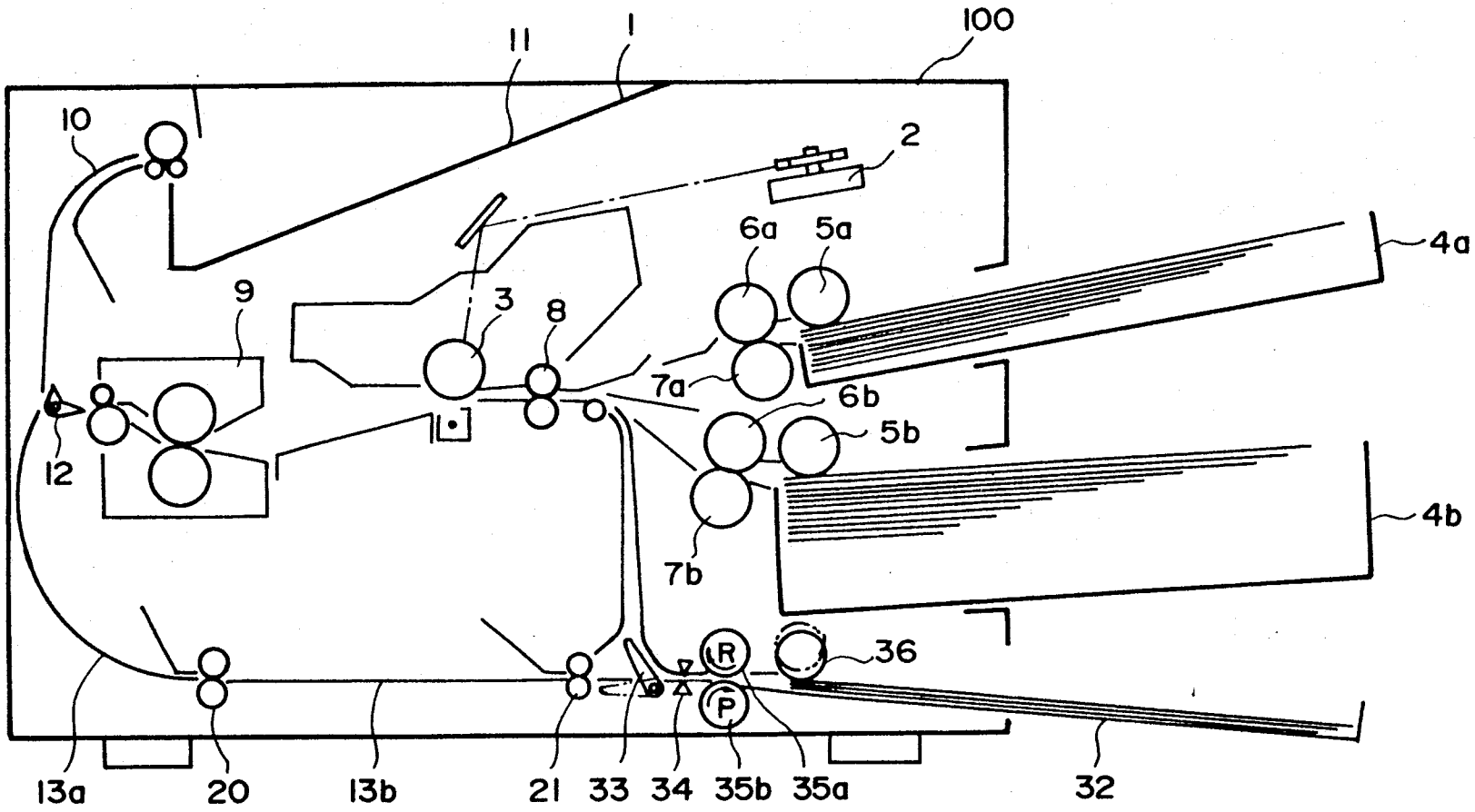

Referring to FIGS. 6 and 7, a third embodiment of the present invention will be described, wherein the same reference numerals are assigned to the elements having the corresponding functions. The apparatus comprises a tray 32 for stacking the sheets S thereon, a flapper 33 and a sensor 34 having the similar functions as in the foregoing embodiments, an upper reversible roller 35*a*, a lower double-feed preventing roller 35*b*, a pick-up roller 36 for picking up the sheet S in the tray 32.

The double-feed preventing roller 35*b* normally rotates in the direction indicated by an arrow P and is connected with an unshown torque limiter, so that the roller 35*b* is stopped or rotated in the opposite direction when the torque over a predetermined level is applied to the roller 35*b*.

In operation for continuous duplex print for N sheets, N sheets are continuously fed out of the cassette 4*a* or 4*b*, and the images of the first, third, fifth,—, (2N-1)th pages are recorded on the first sides. The printed sheets S are introduced into the switch-back station through the reversing passages 13*a* and 13*b*. At this time, the flapper 33 takes the chain line position, and the reversible roller 35*a* rotates in the direction indicated by an arrow Q. The pick-up roller 36 is at the chain line position, that is, it is spaced apart from the sheet S. Therefore, the sheets S having the first side images are stacked in the tray 32 with the printed side facing down and with the N-th sheet on the top. In the tray 32, the sheet length and the sheet width can be set in accordance with the size of the sheet used, manually or automatically.

Figure 8:
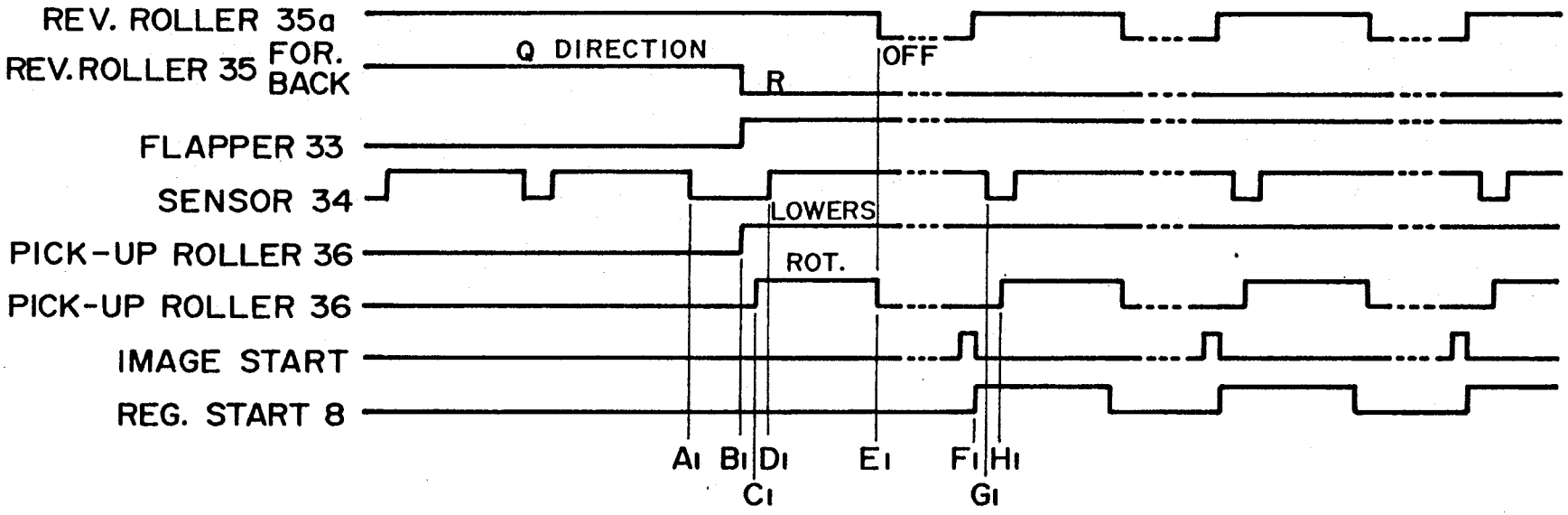
FIG. 8 is a timing chart illustrating the switch-back operation of the third embodiment apparatus.

Referring to FIG. 8, the switch back operation in this embodiment will be described. The trailing edge of the N-th sheet S is detected by the sensor 34 (time A1). After a predetermined period of time elapses from the detection, the pick-up roller 36 is urged to the sheet S with a predetermined pressure shown in FIG. 7 (time B1). Thereafter, the topmost sheet S in the tray 32 is picked up by the roller 36 rotating (time C1). At this time, the flapper 33 is erected as shown by the solid line.

On the other hand, the reversible roller 35*a* reverses its rotation to rotate in the direction R at time B1, so as to advance the sheet S fed out by the pick-up roller 36 toward the most downstream reversing passage 13*c*. If plural sheets S are introduced into between the reversible roller 35 and the double-feed preventing roller 35*b*, the double-feed preventing roller 35*b* rotating in the direction P functions to return the bottommost sheet S back into the tray 32. On the other hand, only one sheet is introduced into therebetween, the torque limiter operates so that the double-feed preventing roller 35*b* follows the sheet S conveyed by the reversible roller 35*a*. The leading edge of the sheet refed by the reversible roller 35*a* is detected by the sensor 34 (time D1). After a predetermined period elapses therefrom, the reversible roller 35*a* stops (time E1). At this time, the leading edge of the sheet abuts the nip formed between the registration rollers 8, and a loop or curve of the sheet is formed. Then, the registration rollers 8 are started to rotate to advance the sheet S into the image recording station (time F1) to effect the second side image formation on the sheet S. At the time when the trailing edge of the sheet passes by the sensor 34 (time G1), the next sheet S is fed out from the tray 32 (time H1). The image recording on the second page size are performed in the order of 2N page, (2N-2) page,—, 2 page. Therefore, on the reverse tray 11, N sheets S are stacked with the first page on the top and facing up.

The description will be made as to the case where the duplex print is performed only on a single sheet S. At the time when the trailing edge of the sheet S having received the first page image passes by the sensor 34, that is, before the sheet S is not completely stacked on the tray 32, the reversible roller 35*a* is reversed to effect the refeeding operation. In this case, the sheet S is not required to be stacked on the tray 32, and therefore, the printing speed is increased. In this embodiment, the pick-up roller is engageable to and disengageable from the sheet S, but the pick-up roller may be in a different type, for example, a crescent roller. As a further alternative, the roller is stationary, while the tray 32 is movable to establish a press-contact between the roller and the topmost sheet S. The tray 32 may be constituted as being detachable from the main assembly 100, as in a cassette. In that case, it is usable as a third cassette. The method of separating the sheet S in the tray 32, may be in the form of a friction separation type using a separation pad.

Figure 9:
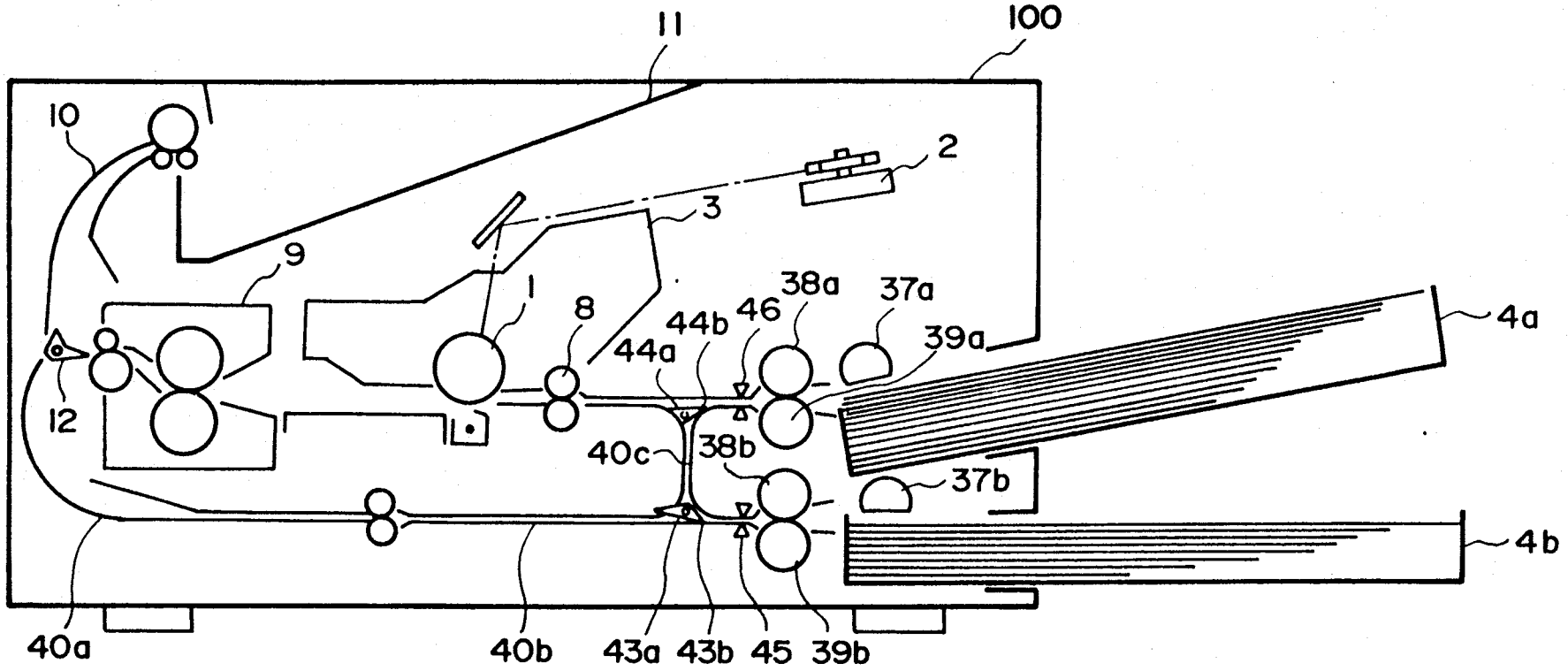
FIG. 9 shows a longitudinal section according to a fourth embodiment of the present invention.

Referring to FIG. 9, a fourth embodiment of the present invention will be described wherein the switching-back is performed using a means for feeding the sheet. In the drawings, the same reference numerals are assigned to the elements having the corresponding functions. In this embodiment, flapper means 43 and 44 are disposed in the merging portion between the most downstream reversing passage 40*c* and feeding passage. The flapper means 43 and 44 include flappers 43*a* and 44*a* and elastic sheets 43*b* and 44*b* made of polyester film or the like, respectively.

Figure 10:
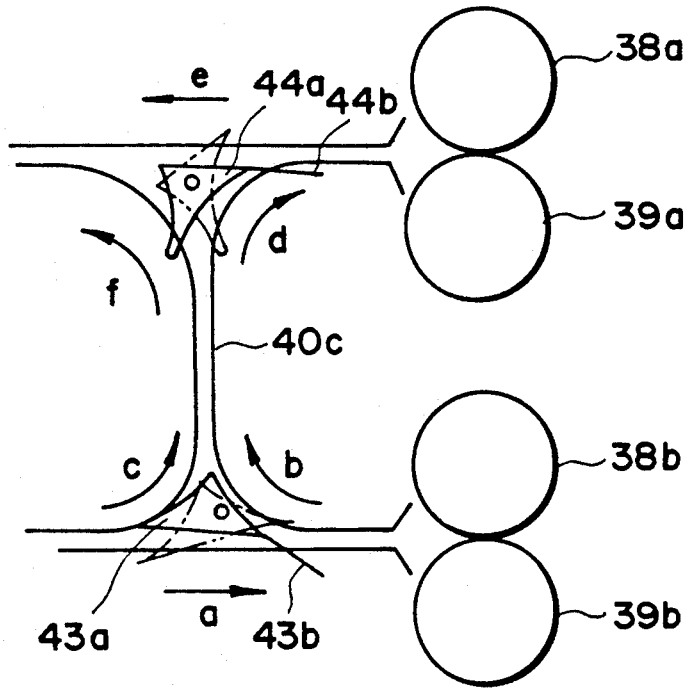
FIG. 10 shows a longitudinal section illustrating a major part of the apparatus of the embodiment.

As best shown in FIG. 10, the flapper means 43 guides the sheet S taking the solid line position to direct it in the directions a and b. When it takes the chain line position, it guides the sheet S in the direction c. The flapper 44 taking the solid line position directs the sheet in the directions d and e. When it takes the chain line position, it directs the sheet in the direction f.

The sheet S conveyed through the reversing passage 40*a* and 40*b* is returned by the operation of the flappers 43 and 44 either to the cassette 4*a* or to the cassette 4*b* (preferably to the cassette from which the sheet is fed for the first side print. In this case, the reversible rollers 38*a* and 38*b* and the double-feed preventing rollers 39*a* and 39*b* are operated in the manner described in conjunction with FIGS. 6 and 7, in accordance with the signals from the sensors 45 and 46. At this time, the crescent pick-up rollers 37*a* and 37*b* are rotated in the direction opposite to the sheet feeding direction.

As described in the foregoing, according to this embodiment, the size of the apparatus can be reduced; and in addition, since the sheet S fed out of a cassette is returned to the same cassette after the first side print, a regulating member for changing the sheet S conveying direction in accordance with the size of the sheet S, can be omitted. It is not inevitable that the sheets S are accommodated in the cassette, since the reversible roller is rotated forwardly and backwardly for one sheet to switch-back the sheet for the second side print operation. In this case, by returning the sheet S having received the first side print to the sheet inlet, the sheet feeding roller can be commonly used for the first side print and for the second side print, by which the variation in the interval between the sheet feed for the first side print and the sheet feed for the second side print, can be reduced.

The present invention is not limited to the duplex print, but it is applicable to a superposing print in which plural images are recorded on the same side of the sheet S.

Referring to FIGS. 11–19, another embodiment of the present invention will be described which is characterized in the lateral registration mechanism.

Figure 11:
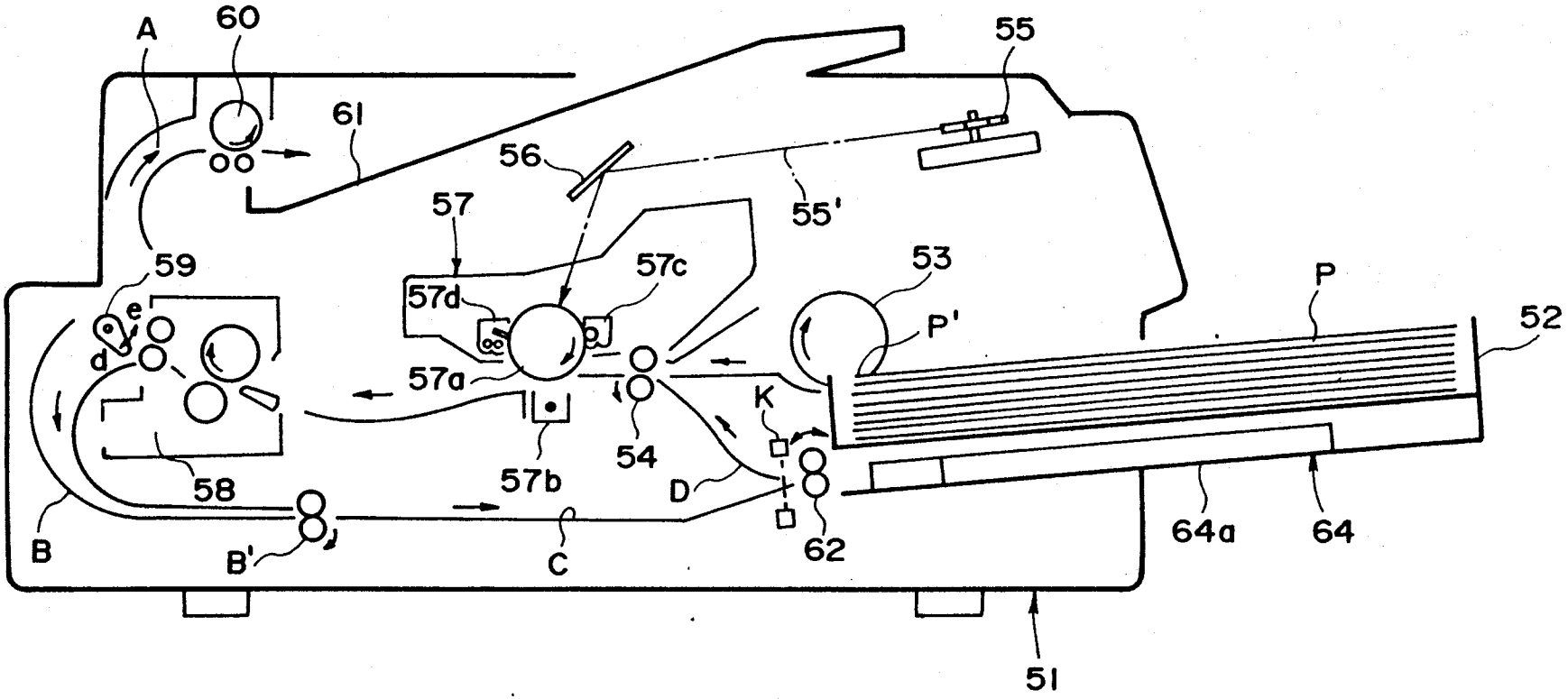
FIG. 11 is a front sectional view of an image recording apparatus according to a further embodiment of the present invention.
Figure 12:
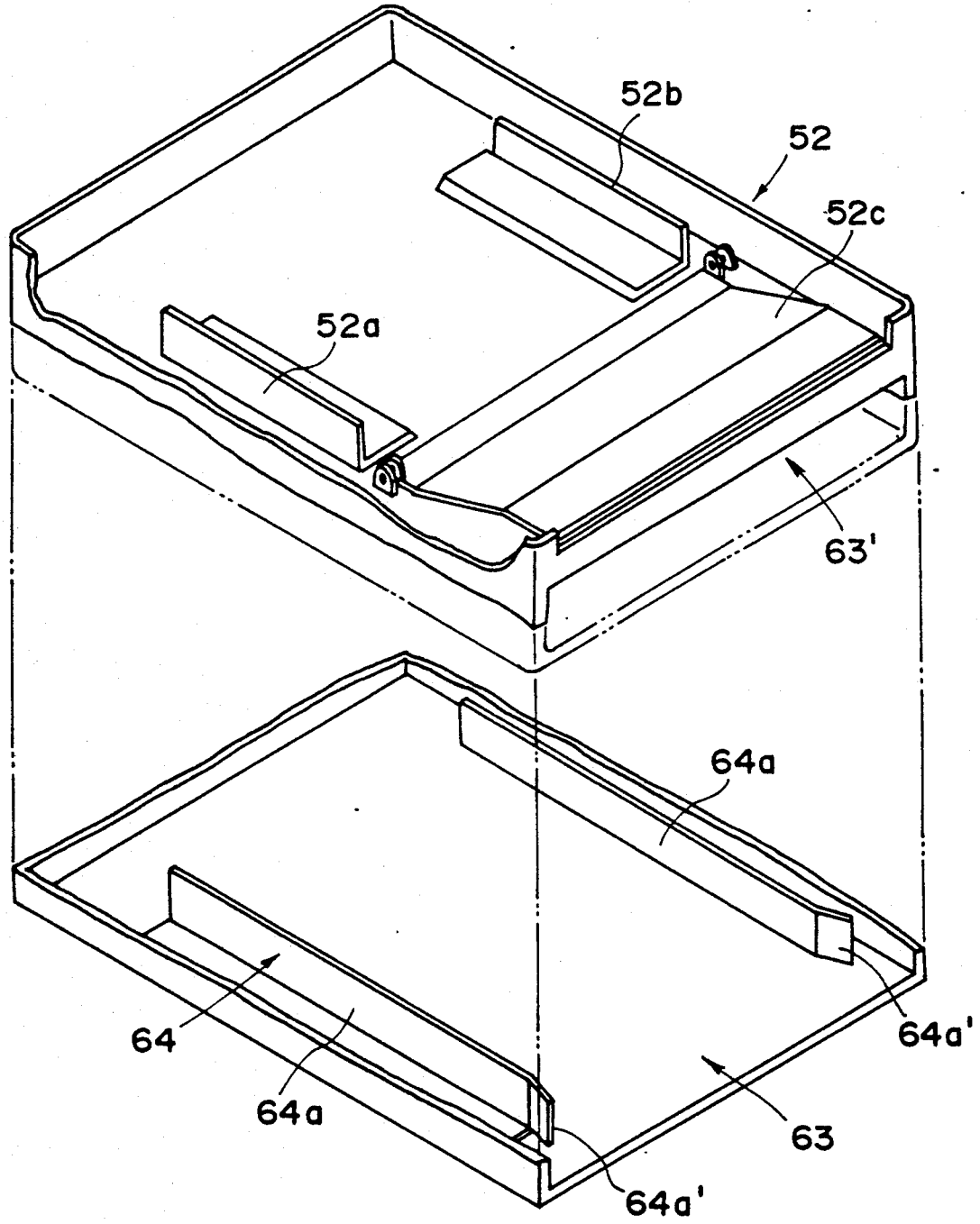
FIG. 12 is an exploded perspective view of a sheet feeding station and a sheet reversing section.

In FIG. 11, an image recording apparatus 51 includes a detachably mountable sheet feeding station 52 in the form of a sheet feeding cassette or a sheet feeding tray accommodating recording sheets P to be fed into the image recording apparatus 51. As shown in FIG. 12, the sheet feeding station 52 has recording sheet setting plates 52*a* and 52*b* for regulating lateral positions of the recording sheets P, and a raising plate 52*c* for raising the leading edge P' of the recording sheet P to a predetermined level.

A sheet feeding roller 53 is rotatable in the direction indicated by an arrow to feed the recording sheet P out of the feeding station 52. The sheet is then conveyed by a registration roller 54 to a recording station which will be described hereinafter.

The image recording apparatus further comprises a laser scanner 55, a reflection mirror 56, the recording station 57 which includes a photosensitive drum 57*a*, a charger 57*b*, a developing device 57*c* and a cleaner 57*d*. Therefore, the laser beam 55' emitted from the laser scanner 55 is projected onto the photosensitive drum 57*a* through the reflection mirror 56 to form an electrostatic latent image thereon. The latent image is visualized by the developing device 50*c*, and is recorded on the recording sheet P by the charger 7*b*.

In an image fixing station 58, the image recorded on the recording sheet P by the recording station 57 is fixed on the recording sheet. A flapper 59 disposed at the outlet of the fixing station 58 is operated to move in the directions d and e.

Discharging rollers 60 are disposed above the fixing station 58 to discharge to the discharge tray 61 the recording sheet P conveyed along the conveying passage A after the image fixing.

Figure 13A:
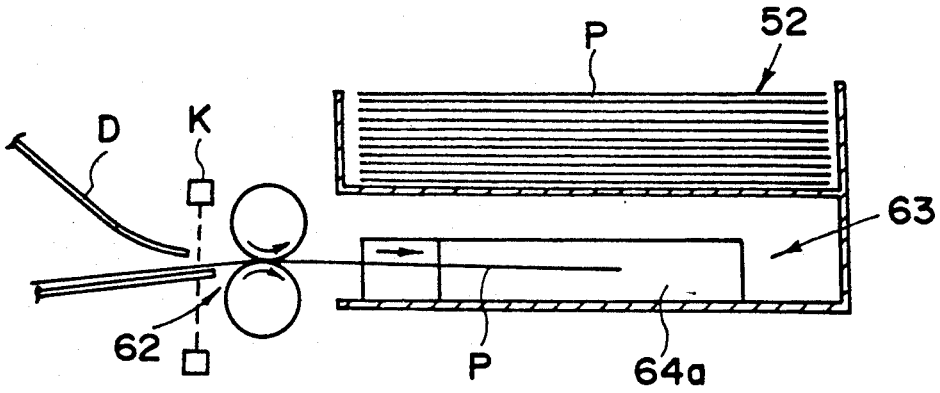
FIGS. 13A–13C illustrate the recording sheet reversing operation.
Figure 13B:
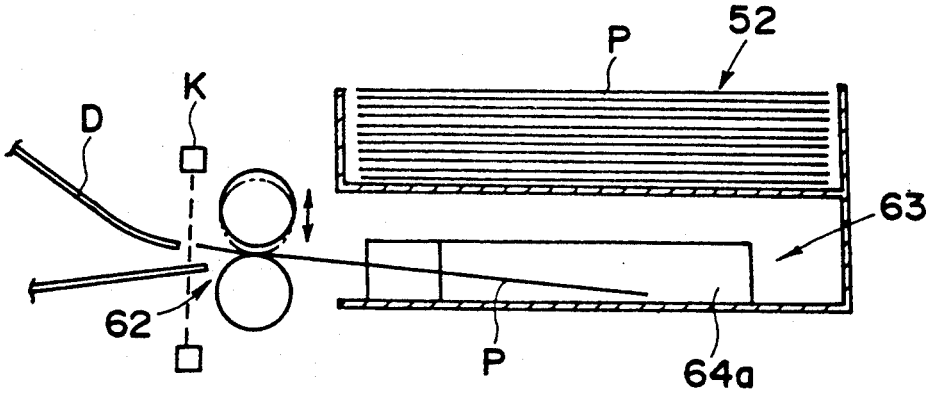
Figure 13C:
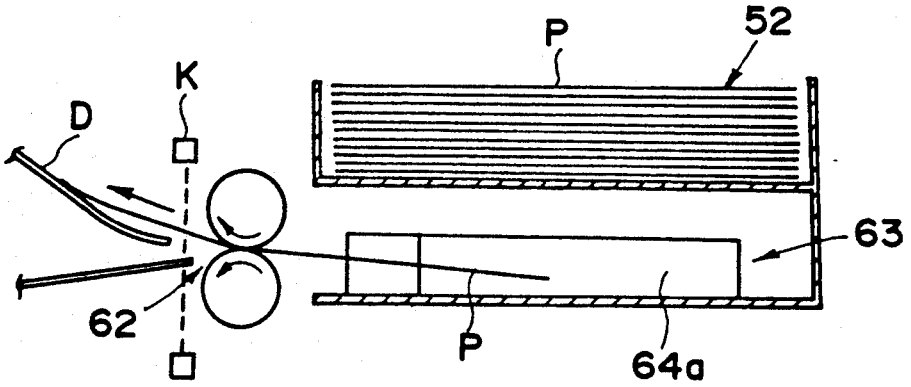
Figure 14:
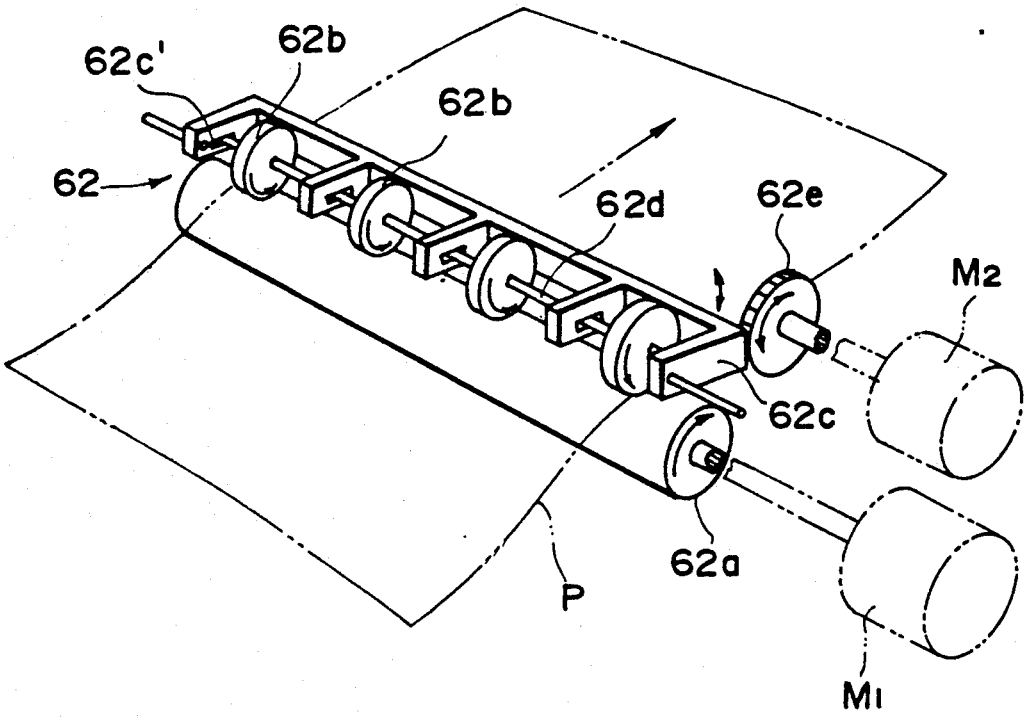
FIG. 14 is a perspective view of a driving roller and a follower roller.

Reversible rollers 62 function to convey to the reversing station the recording sheet P conveyed through the conveying passage and then to a sheet refeeding passage D. As shown in FIG. 14, the reversing rollers 62 include a driving roller 62*a* driven by a driving motor M1 and a plurality of follower rollers 62*a* contacted to the driving roller 62*a* to rotate following the rotation of the driving roller 62. The driving motor M1 is driven through a control system (not shown) containing a timer when the duplex print mode is selected on an operation panel (not shown). As shown in FIG. 13A, during the conveyance of the recording sheet P to the reversing station, the timer is activated to once stop the rotation of the driving roller 62*a* when the detecting means K detects the trailing edge of the recording sheet P, as shown in FIG. 13B. After a predetermined period of time, the timer is deactuated to rotate the driving roller 62*a* in the reverse direction, as shown in FIG. 13C.

As shown in FIG. 14, the follower roller 62*b* is supported through a shaft 62*d* in a groove 62*c'* of a bearing 62*c* which is vertically movable by the rotation of the driving gear 62*e* driven by a motor M2. The motor M2 is driven by the above-mentioned control system (not shown), and when the detecting means K detects the trailing edge of the recording sheet P, an unshown timer is actuated to rotate the driving gear 62*e* in the direction X to move the follower roller 62*b* away from the driving roller 62*a* to stop it. After a predetermined period of time, the timer is deactuated to rotate the driving gear 62*e* in the direction Y to bring the follower roller 62*b* into contact with the driving gear 62*a*.

Figure 15:
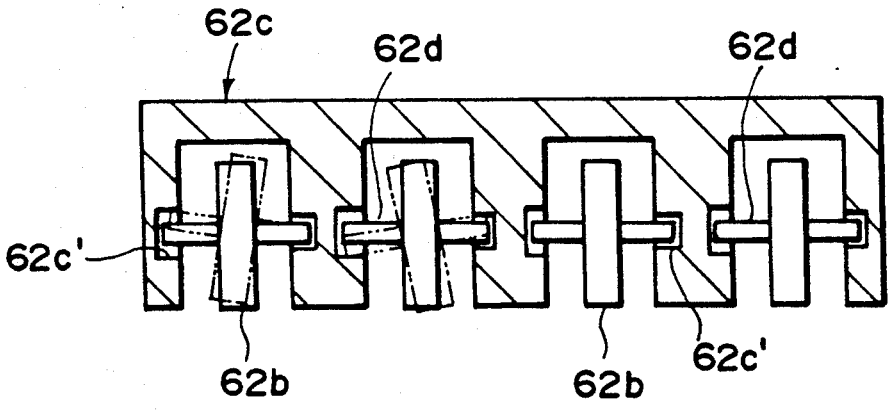
FIG. 15 is a sectional plan view illustrating a follower roller and a bearing.

As shown in FIG. 15, the groove 62*c'* is formed so as to have a larger width adjacent one end of the shaft 62*d*. The follower roller 62*b* is horizontally swingable within a predetermined angle, as shown by the chain lines.

Referring back to FIG. 12, the reversing station for reversing the recording sheet P is integrally formed at a lower side of the recording sheet feeding station 52. The reversing station 63 is to reverse the recording sheet P which has been conveyed through the recording station 57, the fixing station 58, the conveying passage B and the conveying roller B'. The reversing station 63 is provided with adjusting means 64 which adjusts the lateral position of the recording sheet P conveyed to the reversing station 63. The adjusting means 64, in this embodiment, is in the form of a pair of guiding members 64*a* spaced from each other with an interval equal to the width of the recording sheet P accommodated in the sheet feeding station 52. The guiding members 64*a* are extended in the direction of the sheet conveyance.

Figure 16A:
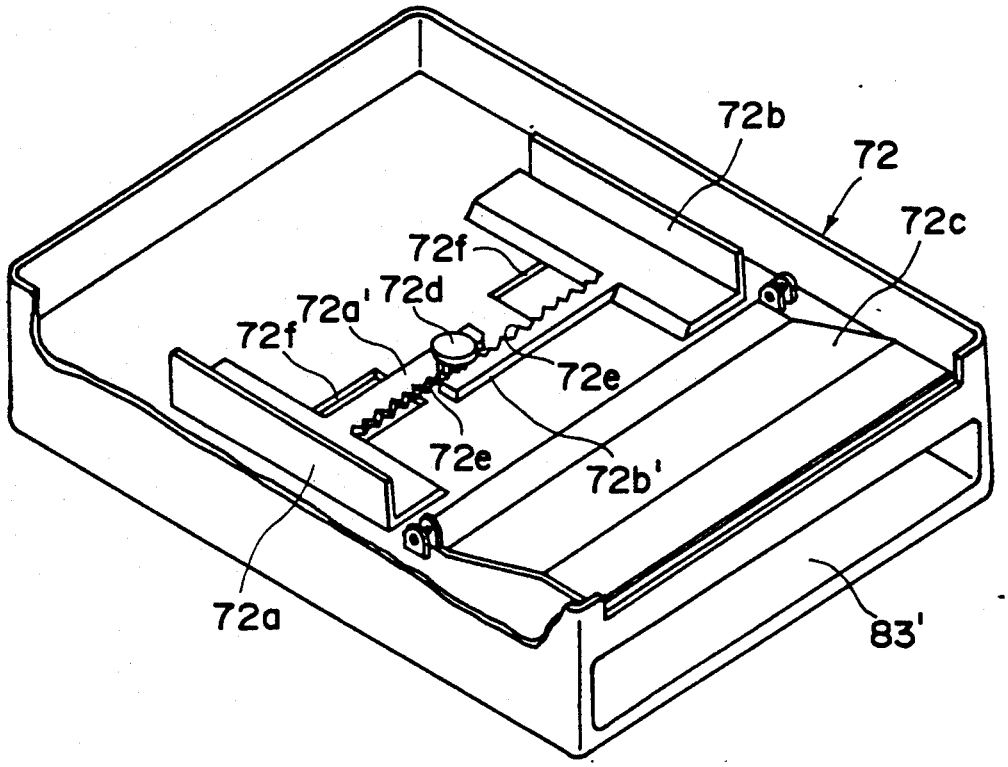
FIG. 16A is a partly broken-away perspective view of the sheet feeding station.
Figure 16B:
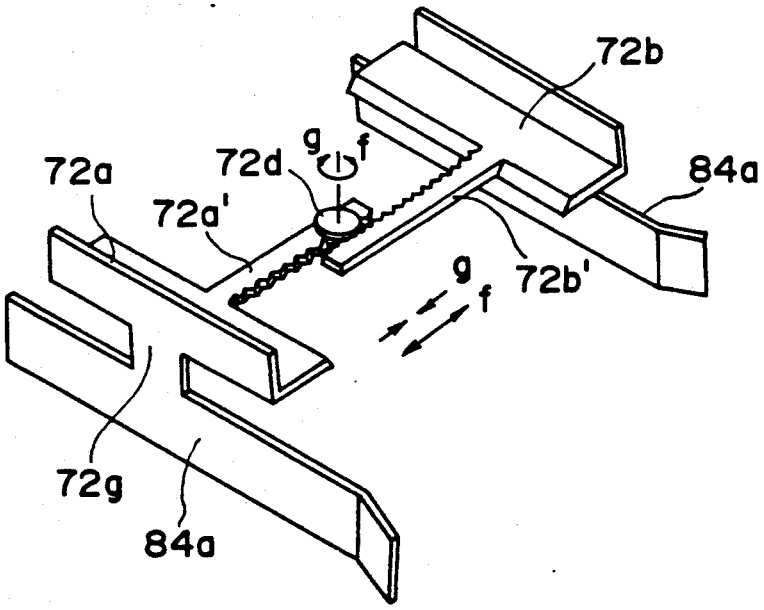
FIG. 16B is a perspective view wherein a recording sheet setting plate and a guiding plate are formed as a unit.

FIGS. 16A and 16B show another example of the adjusting means. A pinion 72*d* is rotatable supported adjacent a center between the recording sheet setting plates 72*a* and 72*b*, and the opposing surfaces of the recording sheet setting plates 72*a* and 72*b* are formed into a projections 72*a*' and 72*b*' having racks 2*e* meshable with the pinion 72*d*. A groove 72*f* is formed in a bottom surface of the feeding station 72. A connecting part 72*g* is extended from the bottom surface of each of the recording sheet setting plates 72*a* and 72*b* toward the reversing station 83, and a diving member 84*a* is connected to the connecting portion 72*g*. As shown in FIG. 16B, when the recording sheet setting plate 72*a* and 72*b* are slid as indicated by arrows f and g in accordance with the size of the recording sheet P, the guiding members 84*a* also slide in the lateral direction.

Figure 19:
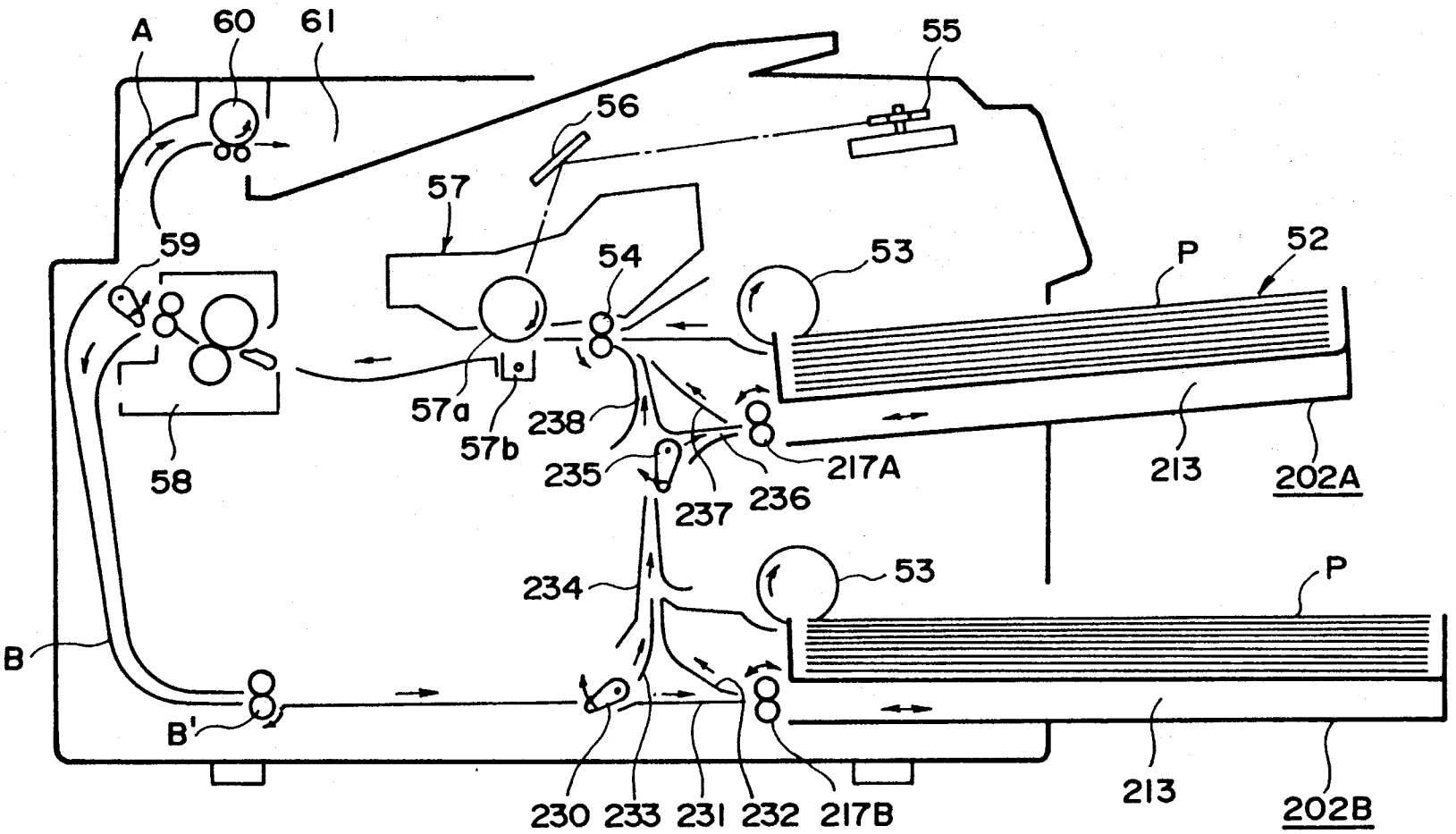
FIG. 19 is a front view of the image forming apparatus according to a further embodiment of the present invention.

FIG. 19 shows a further embodiment, wherein the present invention is applied to an image forming apparatus of a two stage cassette type. The process of recording an image on the recording sheet is the same as the foregoing embodiments, and therefore, the detailed description thereof is omitted. The conveyance of the recording sheet in the duplex print mode will be described.

The recording sheet P fed out of the upper cassette 202A is subjected to the image fixing operation by the fixing device 58 for the first image. By the flapper 59, it is conveyed to the conveying roller B' along the conveying passage B. By the flapper 230, it is passed through conveying passages 233 and 234, and further by a flapper 235, it is passed through a conveying passage 236. The sheet is then advanced by a reversing roller 217A into the reversing station 213 disposed below the cassette 52A. Thereafter, the sheet is subjected to the lateral registration operation which has been described in the foregoing embodiment. Then, the sheet is fed along the conveying guide 237 by the reversing roller 217A, so that it is subjected to the image recording operation on the other side, that is, the side opposite to the side having the first image.

The recording sheet P fed from the lower cassette 202B is conveyed through the conveying passage 234, and is advanced into the recording station 57 through the conveyance passage 238 by the flapper 235, so that a first image is recorded on the recording sheet P. The sheet is then subjected to the image fixing operation by a fixing device 58 for the first image. Then, the sheet is conveyed to the conveying roller B' through the conveying passage B by the flapper 59. The sheet is directed to the conveying passage 231 by the flapper 230, and is conveyed by the reversing roller 217B into the reversing station 213 disposed below the cassette 202B. Thereafter, the lateral registration operation is imparted to the recording sheet P which is the same as the operation described in the foregoing embodiment. The sheet is then conveyed by the reversing roller 217B along the conveying guide 232, 234 and 238, so that a second image is recorded on the opposite side, that is, the side opposite to the first image bearing side. In this embodiment, the two cassette type sheet accommodating means is employed, but it is possible to employ three or more cassettes. In any case, the duplex printing mechanism for various sizes can be provided with a simple structure.

In the embodiment shown in FIG. 11, the reversing roller 62 is provided in the image recording apparatus 51 side, but it may be disposed in the sheet feeding station 52. It is a possible alternative that a one sheet separating means (for example, a vertically movable feeding roller is provided to the adjusting means side of the roller 62, and the sheets are separated one by one by the roller 62) is provided to temporarily accommodate the plural recording sheets. The present invention is not limited to the case of the duplex print, but is applicable to the superimposing print.

In operation, the recording sheet P in the feeding station 52 is fed out by the feeding roller 53 and is fed into the recording station 56 through the registration roller 54. The sheet is then subjected to the image recording operation on the first side, and thereafter, the image is fixed on the recording sheet P in the fixing station 58. When a simplex print is selected, the flapper 59 takes the position indicated by an arrow d, so that the recording sheet P after the image fixing operation is discharged onto the discharging tray 61 through the conveying passage A and the discharging roller 60.

Figure 17:
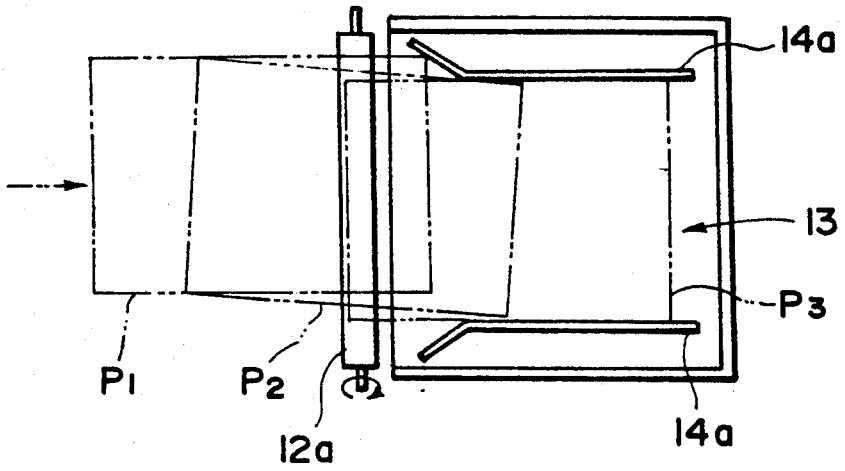
FIG. 17 illustrates the recording sheet which is conveyed to the reversing station.
Figure 18:
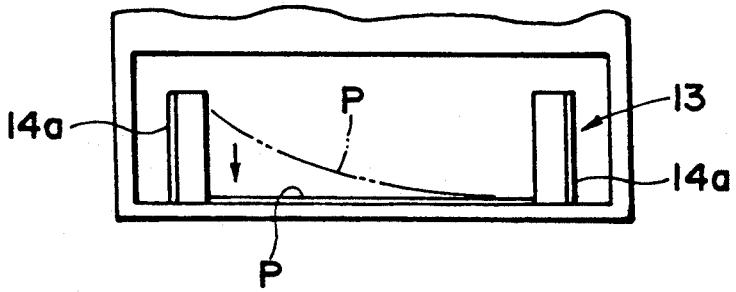
FIG. 18 is a partly broken-away side view when the recording sheet is set on the guiding plate by the weight thereof.

When images are to be formed on both sides of the recording sheet P, the recording sheet P is introduced into the fixing station 58 in the similar manner described above. At this time, the flapper 59 is rotated in the direction e, so that the recording sheet P is conveyed to the reversing roller 62 through the conveying passage B and the conveying roller B' (FIG. 13A). As shown in FIG. 13B, when the detecting means K detects the trailing edge of the recording sheet P, the motor M1 for rotating the driving roller 62*a* stops, and the timer is actuated, and simultaneously the motor M2 is actuated to drive the driving gear 62*e* in the direction X. In the operation, when the recording sheet P is deviated in the lateral direction by the amount P1, as shown in FIG. 17, the leading edge is abutted to the guiding member 62*a*. Since the follower roller 62*b* is swingable in the predetermined angle, the recording sheet P is conveyed into the reversing station 63 along the guiding member 64*a*, sliding on the driving roller 62*a* (P2), and finally the lateral position is adjusted completely as indicated by P3. Even if it is not completely adjusted as shown by chain lines in FIG. 18, the bearing 62*c* moves upwardly by the rotation of the driving gear 62*e* so that the follower roller 62*b* is spaced away from the recording sheet P, and therefore, the recording sheet P is set at a proper position by its weight at a proper position between the guiding members 64*a*, as shown by solid lines. Thereafter, the timers controlling the motors M1 and M2 are deactuated, by which the driving roller 62*a* starts to rotate in the backward direction as indicated in FIG. 13C, so that the follower roller 62*b* is brought into contact with the recording sheet P, by which the recording sheet P is conveyed into the refeeding passage D. In this manner, the recording sheet P which has been subjected to the reversing and lateral registration operations is conveyed into the recording station 56 through the registration roller 54. Thus, in the recording station 56, the image is formed on the second side, that is, the side opposite to the side having the first image. The sheet is discharged onto the discharging tray 61 through the image fixing station 58, the conveying passage A and the discharging rollers 60. At this time, the flapper 59 has been rotated in the direction indicated by d. As regards the structure shown in FIG. 19, the operations are the same as with FIG. 11 embodiment.

While the invention has been described with reference to the structures disclosed herein, it is not confined to the details set forth and this application is intended to cover such modifications or changes as may come within the purposes of the improvements or the scope of the following claims.

What is claimed is:

1. An image recording apparatus, comprising:

sheet material accommodating means for accommodating sheet materials;

sheet material feeding means for feeding the sheet materials from said sheet material accommodating means;

image recording means for recording images on the sheet materials fed by said feeding means;

sheet material refeeding means for refeeding to said image recording means through a refeeding passage the sheet material on which an image has been formed by said image recording means;

sheet material reversing means for reversing the sheet material from said refeeding means and conveying it to said image recording means, said sheet material reversing means being disposed downstream of said refeeding passage with respect to a movement direction of the sheet material and being substantially within an area under said sheet material accommodating means; and an inlet port for permitting supply of sheet material to said sheet material reversing means from a location outside said apparatus.

2. An apparatus according to claim 1, further comprising a sheet material feeding passage for feeding to said image recording means the sheet material fed to said feeding means, a conveying passage for conveying to a discharge outlet the sheet material on which the image has been formed, wherein said refeeding passage constitute a closed passage branching out of said conveying passage and merging into said feeding passage through a portion below said image recording means.

3. An apparatus according to claim 2, wherein said sheet material reversing means includes a passage for branching the sheet material out of said refeeding passage, a merging passage merging into the refeeding passage, and switch-back means for switching back and returning into the merging passage the sheet material coming thereto through said passage for branching the sheet material from said refeeding passage.

4. An apparatus according to claim 3, wherein said passage for branching the sheet material out of the refeeding passage is branched out of a straight portion of said refeeding passage, and further conveys the sheet material along a straight line.

5. An apparatus according to claim 1, wherein said reversing means is provided with a reversible roller.

6. An image recording apparatus, comprising:

sheet material accommodating means for accommodating sheet materials;

sheet material feeding means for feeding the sheet materials from said sheet material accommodating means;

image recording means for recording images on the sheet materials fed by said feeding means;

sheet material refeeding means for refeeding to said image recording means through a refeeding passage the sheet material on which an image has been formed by said image recording means; and sheet material reversing means for reversing the sheet material and conveying it to said image recording means, said sheet material reversing means being disposed downstream of said refeeding passage with respect to a movement direction of the sheet material and being substantially within an area under said sheet material accommodating means, wherein the sheet material having been conveyed through the refeeding passage and the sheet material reversing means to the image recording means, is reversed inn its facing orientation, said sheet material reversing means being provided with switch-back means for reversing the conveying direction of the sheet material and said sheet material reversing means having a sheet protrusion opening at its downstream end.

7. An apparatus according to claim 6, wherein said sheet material accommodating means includes a cassette.

8. An image recording apparatus,comprising:

sheet material accommodating means for accommodating sheet materials;

sheet material feeding means for feeding the sheet materials from said sheet material accommodating means;

image recording means for recording images on the sheet materials fed by said feeding means;

sheet material refeeding means for refeeding to said image recording means through a refeeding passage the sheet material on which an image has been formed by said image recording means;

sheet material reversing means for reversing the sheet material and conveying it to said image recording means, said reversing means being disposed downstream of said refeeding passage with respect to a sheet movement direction;

wherein said sheet material reversing means includes a sheet reversing passage which is formed below and integrally with said sheet material accommodating means.

9. An apparatus according to claim 8, wherein said sheet material accommodating means includes a cassette which is detachably mountable to said apparatus.

10. An apparatus according to claim 9, further comprising a sheet material feeding passage for feeding to said image recording means the sheet material fed to said feeding means, a conveying passage for conveying to a discharge outlet the sheet material on which the image has been formed, wherein said refeeding passage constitute a closed passage branching out of said conveying passage and merging into said feeding passage through a portion below said image recording means.

11. An apparatus according to claim 10, wherein said sheet material reversing means includes an introduction passage for branching the sheet material out of said refeeding passage and introducing it into said sheet reversing passage, and switch-back means for switching back and returning to said refeeding passage the sheet material coming thereto through said introduction passage.

12. An apparatus according to claim 11, wherein said passage for branching the sheet material out of the refeeding passage is branched out of a straight portion of said refeeding passage, and further conveys the sheet material along a straight line.

13. An apparatus according to claim 9, wherein said reversing means is provided with switch-back means for reversing the sheet material conveying direction.

14. An apparatus according to claim 13, wherein the sheet material having been conveyed through the refeeding passage and the sheet material reversing means to the image recording means, is reversed in its facing orientation.

15. An apparatus according to claim 14, said sheet material reversing means is disposed below the sheet material conveying means.

16. An image recording apparatus, comprising:

sheet material accommodating means for accommodating sheet materials;

sheet material feeding means for feeding the sheet materials from said sheet material accommodating means;

image recording means for recording images on the sheet materials fed by said feeding means;

sheet material refeeding means for refeeding to said image recording means through a refeeding passage the sheet material on which an image has been formed by said image recording means;

sheet material reversing means for reversing the sheet material and conveying it to said image recording means, said sheet material reversing means being disposed downstream of said refeeding passage with respect to a movement direction of the sheet material and being substantially within an area under said sheet material accommodating means;

lateral registration means, disposed in said sheet material reversing means, for lateral registration of the sheet material in accordance with a size of the sheet material accommodated in said sheet material accommodating means, wherein said sheet material accommodating means is provided with means for regulating a lateral side of the sheet material, and wherein said lateral registration means is responsive to said regulating means.

said regulating means and said lateral registration means being movable in accordance with a size of the sheet.

17. An apparatus according to claim 16, wherein said sheet material reversing means includes a passage for branching the sheet material out of said refeeding passage, a merging passage merging into said refeeding passage, and switch-back means for switching back and returning into the merging passage the sheet material coming thereto through said passage for branching the sheet material from said refeeding passage.

18. An apparatus according to claim 16, wherein said sheet material accommodating means and said sheet material reversing means are arranged vertically and integrally with each other.

19. An image recording apparatus, comprising:

sheet material accommodating means for accommodating sheet materials;

sheet material feeding means for feeding the sheet materials from said sheet material accommodating means;

image recording means for recording images on the sheet materials fed by said feeding means;

sheet material refeeding means for refeeding to said image recording means through a refeeding passage the sheet material on which an image has been formed by said image recording means;

sheet material reversing means for reversing the sheet material and conveying it to said image recording means, said sheet material reversing means being disposed downstream of said refeeding passage with respect to a movement direction of the sheet material and being substantially within a projection area of said sheet material accommodating means;

lateral registration means, disposed in said sheet material reversing means, for lateral registration of the sheet material in accordance with a size of the sheet material accommodated in said sheet material accommodating means, wherein said sheet material accommodating means is provided with means for regulating a lateral side of the sheet material, and wherein said lateral registration means is responsive to said regulating means wherein said sheet material accommodating means includes a cassette which is integrally formed with said sheet material reversing means below it.

20. An image recording apparatus, comprising:

a plurality of sheet material accommodating means for accommodating sheet materials;

sheet material feeding means for feeding the sheet materials from said sheet material accommodating means;

image recording means for recording images on the sheets materials fed by said feeding means;

sheet material refeeding means for refeeding to said image recording means through a refeeding passage the sheet material on which an image has been formed by said image recording means; and sheet material reversing means for reversing the sheet material and conveying it to said image recording means, said sheet material reversing means being disposed downstream of said refeeding passage with respect to a movement direction of the sheet material and being substantially within an area under said sheet material accommodating means, wherein said plurality of sheet material accommodating means are provided in multi-stage fashion, and each of said accommodating means is provided with said reversing means.

21. An image recording apparatus, comprising:

sheet material accommodating means for accommodating sheet materials;

sheet material feeding means for feeding the sheet material from said sheet material accommodating means;

image recording means for recording images on the sheet materials fed by said feeding means;

sheet material refeeding means for refeeding to said image recording means through a refeeding passage the sheet material on which an image has been formed by said image recording means; and sheet material reversing means for reversing the sheet material and conveying it to said image recording means, said sheet material reversing means being disposed downstream of said refeeding passage with respect to a movement direction of the sheet material and being substantially within an area under said sheet material accommodating means, wherein said reversing means has a tray for stacking thereon plural sheets and feeding means for feeding one by one the sheets out of said tray.

22. An apparatus according to claim 21, wherein said tray is in the form of a detachably mountable cassette.

23. An apparatus according to claim 21, wherein said refeeding means includes a pick-up roller and a separation roller means.

24. An apparatus according to claim 23, wherein said separation roller means includes a forwardly rotatable roller and a backwardly rotatable roller.

25. An apparatus according to claim 24, wherein the backwardly rotatable roller rotates backwardly when the sheet is directed to the tray.

26. An image recording apparatus, comprising:

a plurality of sheet material accommodating means;

sheet material feeding means for feeding the sheet material from said sheet material accommodating means;

image recording means for recording images on the sheet materials fed by said feeding means;

sheet material refeeding means for refeeding to said image recording means through a refeeding passage the sheet material on which an image has been formed by said image recording means;

sheet material reversing means for reversing the sheet material and conveying it to said image recording means, said sheet material reversing means being disposed within said sheet material accommodating means.

27. An image recording apparatus, comprising:

sheet material accommodating means for accommodating sheet materials;

sheet material feeding means for feeding the sheet materials from said sheet material accommodating means;

image recording means for recording images on the sheet materials fed by said feeding means;

sheet material refeeding means for refeeding to said image recording means through a refeeding passage the sheet material on which an image has been formed by said image recording means; and sheet material reversing means for reversing the sheet material conveyed through said refeeding passage and conveying it to said image recording means, said sheet material reversing means being disposed downstream of said refeeding passage with respect to a movement direction of the sheet material and being substantially within an area under said sheet material accommodating means, said sheet material reversing means including at least two rollers which are spaced apart from each other upon receiving the sheet, a flapper for guiding the sheet, detecting means for detecting completion of sheet reception, and control means, responsive to detection by said detecting means, for switching the flapper to cause the flapper to direct a trailing end of the sheet and for bringing the rollers into contact with each other so as to switch back the sheet.

28. An image recording apparatus, comprising:

sheet material accommodating means for accommodating sheet materials;

sheet material feeding means for feeding the sheet materials from said sheet material accommodating means;

image recording means for recording images on the sheet materials fed by said feeding means;

sheet material refeeding means for refeeding to said image recording means through a refeeding passage the sheet material on which an image has been formed by said image recording means; and sheet material reversing means for reversing the sheet material conveyed through said refeeding passage and conveying it to said image recording means, said sheet material reversing means including at least two rollers which are spaced apart from each other upon receiving the sheet, a flapper for guiding the sheet, detecting means for detecting completion of sheet reception, and control means, responsive to detection by said detecting means, for switching the flapper to cause the flapper to direct a trailing end of the sheet and for bringing the rollers into contact with each other so as to switch back the sheet.

29. An image recording apparatus, comprising:

sheet material accommodating means for accommodating sheet materials, said sheet material accommodating means having a first end portion disposed and supported within said image recording apparatus and a second end portion projecting outside of said image recording apparatus;

sheet material feeding means for feeding the sheet materials from said sheet material accommodating means;

image recording means for recording images on the sheet materials fed by said feeding means;

sheet material refeeding means for refeeding to said image recording means through a refeeding passage the sheet material on which an image has been formed by said image recording means; and sheet material reversing means for reversing the sheet material and conveying it to said image recording means, said sheet material reversing means being disposed within said sheet material accommodating means, wherein the sheet material enters said sheet material accommodating means adjacent the first end portion and is directed toward the second end portion, and then it is switched back, and returns into said image forming apparatus adjacent the first end.

30. An image recording apparatus, comprising:

sheet material accommodating means for accommodating sheet materials;

sheet material feeding means for feeding the sheet materials from said sheet material accommodating means;

image recording means for recording images on the sheet materials fed by said feeding means;

sheet material refeeding means for refeeding to said image recording means through a refeeding passage the sheet material on which an image has been formed by said image recording means; and lateral registration means, disposed in said sheet material refeeding means, for lateral registration of the sheet material in accordance with the width of the sheet material in said sheet material accommodating means, wherein said sheet material accommodating means is provided with a means for regulating a lateral side of the sheet material, and wherein a side plate of said lateral registration means is formed integrally with a side plate of said regulating means, said regulating means and said lateral registration means being adjustable in a lateral direction in accordance with the width of the sheet material in said sheet accommodating means.

* * * * *

UNITED STATES PATENT AND TRADEMARK OFFICE

CERTIFICATE OF CORRECTION

PATENT NO. : 5,225,881

DATED : July 6, 1993

INVENTOR(S) : GOTO, ET AL.

It is certified that error appears in the above-indentified patent and that said Letters Patent is hereby corrected as shown below:

COLUMN 1:
Line 38, "roller 111" should read --roller 110--.
Line 41, "10" should be deleted--.

COLUMN 10:
Line 20, "rollers 62a" should read --rollers 62b--.
Line 22, "roller 62." should read --roller 62a--.
Line 67, "rotatable" should read --rotatably--.

COLUMN 13:
Line 29, "constitute" should read --constitutes--.
Line 35, "the" should read --said--.

COLUMN 14:
Line 2, "inn" should read --in--.
Line 41, "constitute" should read --constitutes--.
Line 65, "said" should read --wherein said--.

COLUMN 16:
Line 13, "sheets" should read --sheet--.

Signed and Sealed this

Nineteenth Day of April, 1994

Bruce Lehman

*Attest:*

BRUCE LEHMAN

*Attesting Officer*

*Commissioner of Patents and Trademarks*